US007942486B2

(12) United States Patent
Petri

(10) Patent No.: US 7,942,486 B2
(45) Date of Patent: May 17, 2011

(54) LINEAR GUIDE SYSTEM FOR A SLIDING SHELF

(75) Inventor: Friedhelm Petri, Cramberg (DE)

(73) Assignee: Accuride International GmbH, Diez/Lahn (DE)

( * ) Notice: Subject to any disclaimer, the term of this patent is extended or adjusted under 35 U.S.C. 154(b) by 943 days.

(21) Appl. No.: 11/629,760

(22) PCT Filed: Jun. 7, 2005

(86) PCT No.: PCT/EP2005/052606

§ 371 (c)(1),
(2), (4) Date: Jul. 5, 2007

(87) PCT Pub. No.: WO2006/000523

PCT Pub. Date: Jan. 5, 2006

(65) Prior Publication Data

US 2007/0261199 A1 Nov. 15, 2007

(30) Foreign Application Priority Data

Jun. 25, 2004 (DE) ..... 10 2004 030 899 U

(51) Int. Cl.
*A47B 95/00* (2006.01)

(52) U.S. Cl. ..... 312/333; 312/334.44; 312/334.7

(58) Field of Classification Search ..... 312/410, 312/334.1, 333, 334.44, 334.46, 334.2, 334.3, 312/334.7, 334.8, 334.9, 334.11; 219/392; 126/339

See application file for complete search history.

(56) References Cited

U.S. PATENT DOCUMENTS

| | | | | |
|---|---|---|---|---|
| 3,791,371 | A * | 2/1974 | Oatley | 126/339 |
| 6,412,891 | B1 * | 7/2002 | Liang et al. | 312/334.44 |
| 6,789,861 | B1 * | 9/2004 | Dobberstein | 312/330.1 |
| 6,854,379 | B2 | 2/2005 | Pattle et al. | 99/393 |
| 6,979,065 | B2 * | 12/2005 | Egger | 312/333 |
| 2003/0079615 | A1 * | 5/2003 | Pattle et al. | 99/448 |
| 2004/0003726 | A1 * | 1/2004 | Geberzahn et al. | 99/426 |
| 2004/0056572 | A1 * | 3/2004 | Chen et al. | 312/333 |
| 2004/0069299 | A1 | 4/2004 | Le et al. | 126/337 R |
| 2005/0039299 | A1 * | 2/2005 | He | 16/96 R |

FOREIGN PATENT DOCUMENTS

| | | |
|---|---|---|
| AT | 91666 | 5/1922 |
| AT | 22607 | 1/1987 |
| DE | 10051153 | 4/2002 |
| DE | 10151899 | 4/2003 |
| DE | 10202131 | 7/2003 |
| EP | 91666 | 10/1986 |
| EP | 0998865 | 5/2000 |
| WO | WO2005003636 | 1/2005 |

* cited by examiner

*Primary Examiner* — Darnell M Jayne
*Assistant Examiner* — Andres Gallego
(74) *Attorney, Agent, or Firm* — Michael L. Dunn

(57) ABSTRACT

A linear guide system having a slide-out member including a support element and two elongate guides extending rearwardly laterally of the support element and having at least one pair of stationary outer rails mounted in a horizontally extending position on the inside of a carcass wall and slides each of which is slidably supported on a respective outer rail along the length thereof. An engagement apparatus is provided for bringing the guides of slide-out members into engagement with slides and a locking apparatus is provided for locking at least one slide in an extended position with respect to displacement travel of the slide-out member and locks the slide against displacement when a guide of the slide-out member is brought out of engagement with the slide and unlocks the slide for displacement along the outer rail when the guides of the slide-out member is brought into engagement with the slide.

23 Claims, 6 Drawing Sheets

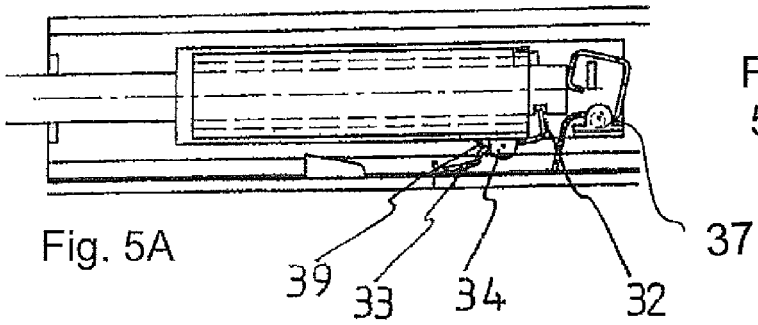
Fig. 5A
Fig 5B
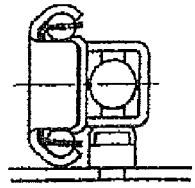
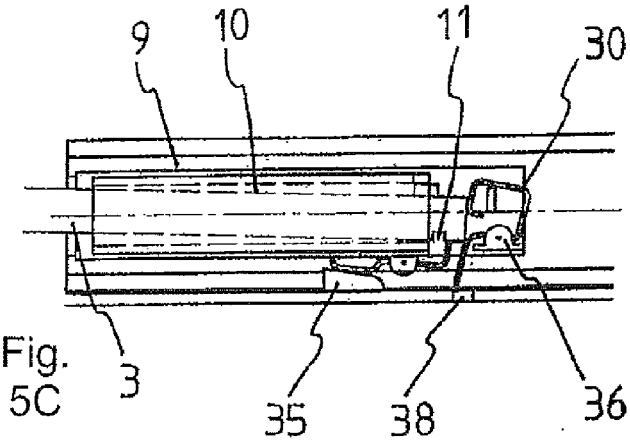
Fig. 5C
Fig. 5D
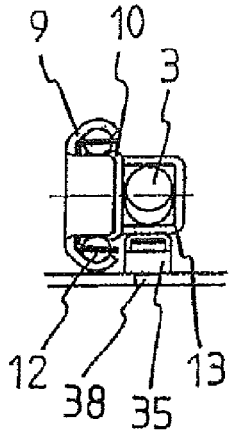
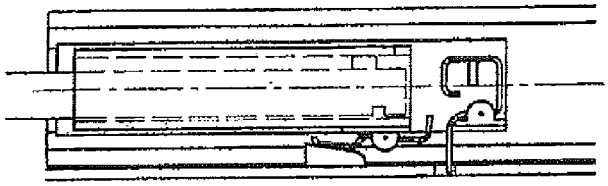
Fig.5E
Fig. 5F
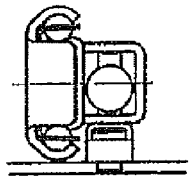

LINEAR GUIDE SYSTEM FOR A SLIDING SHELF

BACKGROUND OF THE INVENTION

The present invention concerns a linear guide system for a slide-out member in a drawer system, a baking oven or the like.

The linear guide system according to the invention is suitable for any kind of slide-out members such as drawers, computer racks and other sliding members which are fixed in a cupboard or carcass and which are moved in and out. The invention however is quite particularly suitable for holding and guiding supports for items to be cooked in baking ovens. The term "supports for items to be cooked" which in the sense of this invention represent a slide-out member is used to denote all insert sliding members which are usually employed in baking ovens such as baking sheets, grills, baking pans, drip pans as well as holders for such sliding members, such as for example frames into which such supports for items to be cooked can be inserted or on which they can be placed.

In the context of this application the guide system according to the invention for a slide-out member is described primarily for supports for items to be cooked or similar insert sliding members in an oven. It will be clear however that the present invention is not limited to guide systems for baking ovens but also embraces within the scope of the appended claims other uses in respect of which corresponding guide systems can be used in a suitable fashion.

Sliding member guide systems for supports for items to be cooked in baking ovens are known in many different forms. In simple known ovens the support for items to be cooked is guided in grooves provided at different heights or levels in the side wall of the oven. The sliding characteristics of the supports for the items to be cooked in such grooves depend on the surface nature of the surfaces which slide against each other and the loading on the support for the items to be cooked and are comparatively poor. In other systems, instead of the grooves, grids with horizontal bars are fixed to the side walls of the oven, with the supports for the items to be cooked being guided on the bars. Here the sliding characteristics are improved somewhat in comparison with grooves, by virtue of the smaller support contact area. Both systems suffer from the disadvantage that the support for the items to be cooked can be pulled out of the oven only as far as a given distance without it tilting downwardly or having to be supported at the front. In improved ovens, telescopic guides are provided at the side wall of the oven or on a grid, wherein the telescopic guides each have a respective stationary rail and one or more movable rails which are mounted slidably in the longitudinal direction relative to the stationary rail and out of the oven. A support for items to be cooked can be placed on the movable rails so that, by pulling the telescopic guides out of the oven, the support can be pulled out. Telescopic guides are characterised in that the individual rail elements which are supported slidably relative to each other are of substantially the same or at least similar length. In the case of a so-called partial slide-out member which includes one stationary rail and one movable rail, the telescopic guide, by virtue of the ball bearing arrangements provided and so that the individual rail elements do not become separated from each other, can be extended out only as far as a length which is less than double the length of the rails in the fully retracted condition. In the case of the so-called full slide-out arrangement, two or more movable rail elements are supported slidably with respect to the stationary rail element. A telescopic guide which in the form of a full slide-out arrangement can be extended to double the length of the completely retracted condition or beyond same.

DE 101 51 899.4 A1 describes a rail system for supports for items to be cooked in an oven comprising a support for items to be cooked which on each of two sides has respective holding loops which in the front portion of the support for the items to be cooked are connected to the support by way of a connecting portion of a substantially U-shaped configuration, and which extend substantially parallel to the respective side edges of the support for the items to be cooked, and comprising telescopic rails which respectively have a stationary rail fixed to or behind the side wall of the baking oven muffle and an inner rail which is slidable relative to the stationary rail out of the baking oven, wherein provided on the inner rail is a receiving tube which extends substantially over the length of the inner rail and which forms a unit therewith and which is open in the direction of the baking oven opening and which is adapted to receive the holding loop by insertion therein, wherein the holding loop has a hook and the receiving tube has a latching apparatus in the form of a recess or opening to prevent the holding loop from sliding out of the receiving tube. That system provides a structure which can be produced inexpensively and which allows the support for items to be cooked to be pulled out of the oven to a position in front thereof in a stable fashion with an easy sliding movement and without the support tilting. The telescopic rails in that system are very substantially protected from fouling by items being cooked and sprayed fat or fat vapours or other liquids. It will be noted however that the system suffers from the disadvantage that the entire receiving tube in which the holding loop is arrested moves out of and projects from the oven when the support for the items being cooked is pulled out. When the support for the items to be cooked, for removal from the oven, is firstly pulled out with the receiving tube and then removed therefrom, the receiving tube remains projecting in front of the oven and has to be pushed in again by hand in order to close the oven. If the support, for removal from the oven, is released from the receiving tube while the latter is in the inward position, there is the danger that, by virtue of the ease with which it moves, the receiving tube is also pulled out of the oven when the holding loop is pulled out, and then also has to be pushed back in again after removal of the support therefrom. As a respective receiving tube is provided on each of the two sides of the support for the items to be cooked, there is the further problem that, when inserting the support, one receiving tube is moved further out of the oven and another receiving tube is moved further thereinto, or that occurs when inserting the support for the items to be cooked, and that considerably increases the difficulty of inserting the support.

BRIEF DESCRIPTION OF THE INVENTION

The problem of the present invention was that providing a guide system for a slide-out member, in particular for a support for items to be cooked in a baking oven, which overcomes the known disadvantages of the state of the art. In accordance with the invention that problem is solved by a linear guide system for a slide-out member in a drawer system, a baking oven or the like, comprising

- a slide-out member which includes a support element and two elongate guides extending rearwardly laterally of the support element,
- at least one pair of stationary outer rails which are mounted in a horizontally extending position on the inside of a carcass wall and at each outer rail a slide which is supported on the outer rail slidably along the length thereof, engagement means for bringing the guide of the slide-out member into engagement with the slide, and locking means for locking the slide to prevent displacement along the outer rail, which are adapted for locking the slide in an extended position with respect to the displacement travel of the slide-out member, wherein the locking means for locking the slide to prevent displacement along the outer rail are so adapted that they lock the slide against displacement when the guide of the slide-out member is brought out of engagement with the slide and unlock the slide for displacement along the outer rail when the guide of the slide-out member is brought into engagement with the slide.

A linear guide system as is the subject-matter of the present invention differs from the telescopic guide system described hereinbefore in that it has a long stationary rail element which is referred to herein as the outer rail and a very short movable rail element which is referred to herein as the slide. The slide is displaceable substantially over the full length of the stationary outer rail (less the length of the slide). The sliding support for the slide on the stationary outer rail is effected as in the case of known telescopic guides by way of a plain bearing, a rolling or roller bearing or a ball bearing, in which respect the latter affords the best sliding properties.

BRIEF DESCRIPTION OF THE DRAWINGS

FIG. 5 shows detail views of a third variant (variant 3) of the linear guide system in various stages in insertion of a slide-out member.

DETAILED DESCRIPTION OF THE INVENTION

Figure 1A:
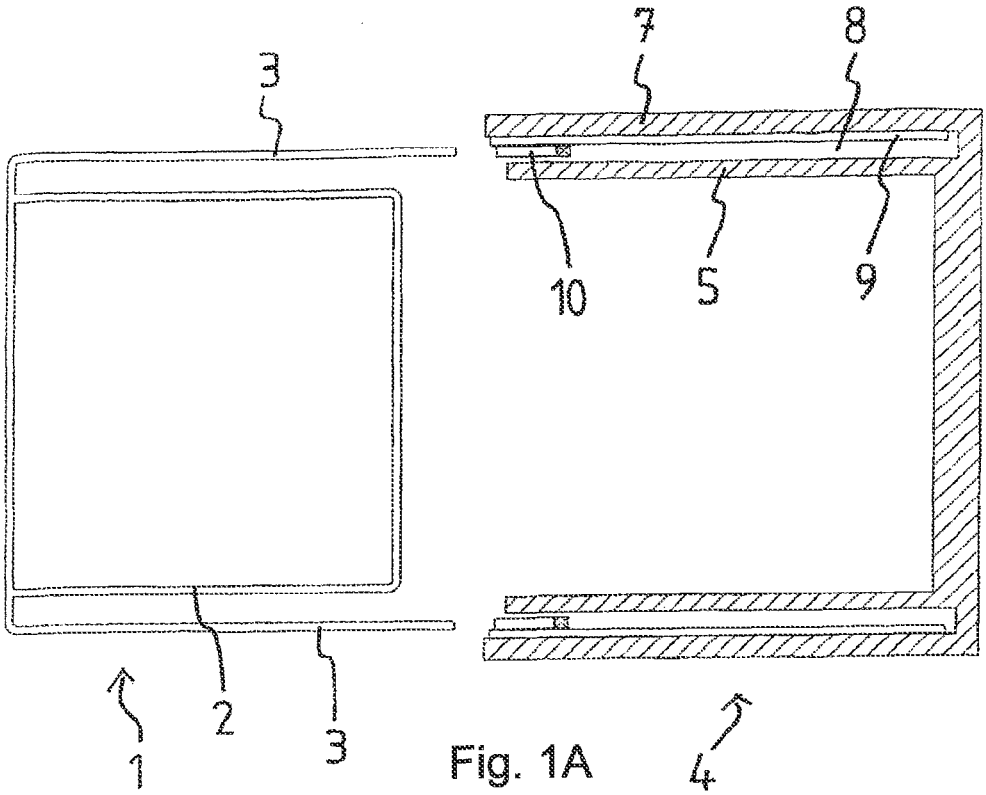
FIG. 1 is a view in cross-section from above showing a baking oven with a linear guide system according to the invention with the slide-out member removed and with the slide-out member introduced.

In relation to the elongate guides the expression "extending rearwardly" signifies that those elongate guides are fixed in the front region or somewhere laterally to the support element and extend substantially in the push-in direction, that is to say towards the rear wall of the carcass or the baking oven. The ends of the elongate guides, that is to say the ends which are in opposite relationship to the fixing of the guides to the support element, project freely rearwardly. In the region of those rear free ends, the guides, upon being fitted into a carcass or baking oven, are brought into engagement with the slide so that they are securely held to the slide or components mounted thereto. The guide of the slide-out member is brought into engagement with the slide in such a way that the slide-out member with the slide can be reliably moved along the length of the outer rail into the carcass or baking oven and out again without being inadvertently released from the slide upon being pulled out, and falling down.

A particular advantage of the linear guide system over conventional telescopic rail systems lies in the use of a slide which is short in relation to the long rail elements of a telescopic rail system, which uses less material and which therefore is less expensive to produce. Furthermore the slide has the advantage that it remains in the carcass or baking oven and is not moved out of same. It cannot therefore also project from the carcass or oven.

It is particularly advantageous in the linear guide system according to the invention that there are provided locking apparatus for locking the slide to prevent displacement thereof along the outer rail, which are adapted for locking the slide in an extended position with respect to the displacement travel of the slide-out member. That locking of the slide in the front portion of the outer rail to prevent displacement of the slide is effected when the slide-out member or support for items to be cooked is removed from the carcass or baking oven, that is to say when the slide-out member or support is released from the slide. The two slides which are provided on one plane in the carcass or baking oven for holding the slide-out member at the two sides thus remain locked in the front portion of the outer rail until a slide-out member is again fitted into the carcass or baking oven and brought into engagement with the slide. It is only then that the locking action is released and the slides can be moved along the outer rails for inserting the slide-out member. That effectively prevents one or both slides being displaced or moving away when inserting the slide-out member and effectively prevents the operation of inserting the slide-out member from being made considerably more difficult.

A further advantage of the system according to the invention is that the engagement apparatus for engagement of the guide of the slide-out member with the slide and the locking apparatus for locking the slide to prevent displacement along the outer rail are so designed and matched to each other that the locking apparatus for locking the slide are released whenever the guides for the slide-out member are brought into engagement with the slide by way of the engagement apparatus, that is to say when inserting the slide-out member into the carcass or baking oven. Conversely the slide is locked to prevent displacement along the outer rail when the guides for the slide-out member are separated from the slide, that is to say the engagement apparatus on the guide and the slide are released. Locking and unlocking of the slide with respect to the outer rail is thus effected automatically when removing the slide-out member from the carcass or oven or when inserting it thereinto. Additional locking or unlocking of the slide, which would require additional manual actions and would be uncomfortable and inconvenient to the user and in the case of an oven would possibly be dangerous because of the heat is thus eliminated.

Desirably the slide of the linear guide system is supported displaceably along the outer rail by a sliding guide, a roller or rolling bearing or a ball bearing, in which respect the use of a ball bearing arrangement is particularly preferred.

In a preferred embodiment of the linear guide system according to the invention the elongate guides are in the form of bars or tube profiles of circular or polygonal cross-section and extend rearwardly in parallel relationship with the side edges of the support element.

In a further particular embodiment of the linear guide system according to the invention the elongate guides extend rearwardly beyond the rear boundary of the support element. The further the elongate guides extend rearwardly beyond the boundary of the support element, the correspondingly further can the support element of the slide-out member be extended to a position in front of the carcass or the baking oven. Alternatively the elongate guides can extend only as far as the rear boundary of the support element or still less, in which case however the slide-out member cannot then be extended completely to a position in front of the carcass or baking oven as the end portion of the elongate guides remains in the carcass or oven in engagement with the slide over a length which approximately corresponds to the length of the slide.

The shorter the slide is in relation to the length of the outer rail, the correspondingly greater is the displacement travel of the slide along the outer rail. It is therefore desirable in accordance with the invention if the length of the slide is at most ⅓, preferably at most ¼, particularly preferably at most ⅕ of the length of the outer rail.

According to the invention, for introducing and engaging the guide with the slide, it is advantageous if provided on the slide is a receiving apparatus which is preferably in the form of a tube profile member or U-shaped profile member which extends in the longitudinal direction of the slide and is fixed thereto. If the receiving apparatus is in the form of a U-shaped profile member the free ends of the limbs of the U-shape are towards the slide and form therewith a tube or tubular configuration for introduction of the guide on the slide-out member.

In a further preferred embodiment of the linear guide system according to the invention the engagement apparatus for engagement of the guide of the slide-out member with the slide include a latching opening on the guide and a latching nose or latching tongue which is fixedly connected to the slide and which can be brought into engagement with the latching opening. The latching opening is desirably a notch arranged in the region of the free end of the guide. For engagement of the guide with the slide the latching nose or latching tongue which is fixedly connected to the slide moves into the latching opening and prevents the slide-out member from being released from the slide for example upon being pulled out of the carcass or oven, and falling down. In particularly preferred embodiments of the linear guide system according to the invention the latching nose or latching tongue is moved out of the latching opening when the slide-out member is lifted in the front region and in that case tilted. That configuration prevents the slide-out member being released from the slide in normal operation, that is to say when the slide-out member is moved horizontally into or out of the carcass or oven. In addition however it also permits release, which is very simple to implement, of the slide-out member from the slide and removal from the carcass or oven without additional manual actions being required to release any fixing apparatus. Thus an operator can grip a slide-out member with both hands and simply remove it from the carcass or oven and possibly re-insert it at a different level.

In a further preferred embodiment of the linear guide system according to the invention the locking apparatus for locking the slide to prevent displacement along the outer rail include on the slide a locking pin and on the stationary outer rail or a part fixedly connected thereto a locking opening or locking bore into which the locking pin engages for locking the slide to prevent displacement along the outer rail. As already stated hereinbefore those locking apparatus engage whenever the guides of the slide-out member are released from the slide and the slide-out member is removed from the carcass or oven. Desirably the locking pin is biased resiliently by a spring in the direction of the locking opening or locking bore. Alternatively the locking apparatus can be of such a configuration that the locking pin is subjected to a force in the direction of the locking opening or locking bore, due to the force of gravity. Both alternatives ensure that the locking pin moves reliably into the locking opening or locking bore in order to lock the slide to prevent displacement along the outer rail when the slide-out member is removed from the carcass or oven.

With knowledge of the invention the linear guide system which is described herein and defined in the appended claims and in particular the function and the co-operation of the engagement apparatus and locking apparatus according to the invention can be structurally designed in various ways. The man skilled in the art in this field will be able to design embodiments which fall within the scope of the linear guide system according to the invention without in so doing departing from the invention. Therefore the scope of protection of this application also embraces those embodiments which are not described herein in every design detail. Some particularly preferred variants of the linear guide system according to the invention are set forth hereinafter.

Variant 1

In a particularly preferred variant of the linear guide system according to the invention the locking apparatus for locking the slide to prevent displacement along the outer rail have a locking guide mounted to the slide and a locking member which is guided slidably on the locking guide and from which a locking pin projects. The locking guide, locking member and the locking pin are so arranged and designed that the locking member on the locking guide is displaceable slidingly between positions in which on the one hand the locking pin for locking the slide to prevent displacement along the outer rail engages into a locking opening or locking bore and on the other hand the locking pin is lifted out of the locking opening or locking bore. Desirably, the locking member in this variant has an opening which is designed for engagement with the end portion of the guide. The slidably guided locking member is displaceable on the locking guide in a vertical direction. The locking pin projects downwardly from the locking member, where a corresponding locking opening or locking bore is provided at the outer rail, a component fixed to the outer rail or a plate member fixed to the wall. When the slide-out member is removed the locking member is disposed vertically in a lower position and the locking pin engages into the locking opening or locking bore so that the slide is locked to prevent displacement with respect to the outer rail.

When inserting the slide-out member it is moved with the end portion of the guide in a slightly inclined position towards the locking member and comes into engagement therewith for example by way of the above-mentioned opening on the locking member. When the slide-out member is then moved downwardly at the front end and thus moved into a horizontal position, the end portions of the guide urge the locking member upwardly in a vertical direction, in which case the locking member is guided slidingly on the locking guide. In that situation the locking pin is also lifted and moved out of the locking opening or locking bore so that the locking action for the slide in relation to the outer rail is nullified and the slide together the slide-out member can be moved into the carcass or oven.

The end portions of the guides on the slide-out member desirably have on the top side latching openings. Provided on the slide or on the receiving apparatus which is fixed to the slide is a corresponding latching tongue which upon tilting movement of the slide-out member together with the guides into the horizontal position engages into the locking openings at the end portions of the guide. In that way the slide-out member or the end portions of the guides on the slide-out member is or are brought into engagement with the slide when the slide-out member is inserted, and prevented from being pulled out of the receiving apparatus or released from the slide.

The locking member which is slidingly guided on the locking guide can desirably be biased downwardly by a spring in a vertical direction so that, upon removal of the slide-out member, the locking pin is reliably urged into the locking bore or locking opening provided for same. In a suitable design configuration it may alternatively be sufficient if the locking member is subjected to a force in the direction of the locking opening or locking bore, due to the force of gravity.

Variant 2

In a second preferred variant of the linear guide system according to the invention the locking apparatus for locking the slide to prevent displacement along the outer rail have on the slide or in the receiving apparatus a spring support mounted to the slide and a leaf spring which is fixed to the spring support and from which a locking pin extends. In that case the free end of the leaf spring, which end is in opposite relationship to the end of the leaf spring that is fixed to the spring support, points in the direction in which the slide is pulled out.

Desirably, in the linear guide system of this variant, provided on the slide or in the receiving apparatus there is moreover an inclined introduction portion for introduction of the guide. The inclined introduction portion is arranged in such a way that, upon introduction of the guide into the receiving apparatus, the introduction portion moves the end portion of the guide to the free end of the leaf spring in such a way that the leaf spring is deformed against its spring bias and in that case lifts the locking pin out of the locking opening or locking bore.

The free end portions of the guides of the slide-out member have a latching opening on their side which is the upper side in the vertical direction. For engagement of the guide of the slide-out member with the slide, a part of the inclined introduction portion is so designed and arranged that, when the guide is introduced into the receiving apparatus, the introduction portion engages into the latching opening at the end portion of the guide.

As in the case of the first variant described hereinbefore, this variant also provides that the slide-out member, when being fitted into the carcass or oven, is introduced in a slightly tilted condition with the end portions of the guides, into the receiving apparatus on the slide. Each end portion of a guide is then guided along under the inclined introduction portion, to the leaf spring which is arranged behind the inclined introduction portion in the direction of the introduction movement. The free end of the leaf spring is held curved upwardly by an abutment in the receiving apparatus to such an extent that the free end of the guide is guided under the free end of the leaf spring and urges it further upwardly. A locking pin which projects downwardly from the leaf spring engages into a locking bore on the outer rail or on another stationary part. Upon introduction of the end portions of the guide of the slide-out member and upward flexing of the leaf spring in opposite relationship to its spring bias, the locking projection is lifted out of the locking bore and thus the locking between the slide and the outer rail is removed. The depth of introduction of the free end of the guide of the slide-out member is defined by an abutment so that the latching opening at the free end of the guide comes to lie at the end of the introduction movement under the part of the inclined introduction portion, which is intended to move into the latching opening. As soon as the slide-out member together with the guides is then moved into a horizontal position, that part of the inclined introduction portion moves into the latching opening and brings the guide of the slide-out member into engagement with the slide. The slide-out member is now secured to the slide and the slide is unlocked with respect to the outer rail so that the slide-out member can be moved into the carcass or oven. Removal of the slide-out member is effected with movements in the reverse sequence.

Variant 3

In a third variant of the linear guide system according to the invention the locking apparatus for locking the slide to prevent displacement along the outer rail have on the slide or in the receiving apparatus a locking lever which is mounted rotatably on a lever carrier and which is resiliently biased by a spring in the locking direction, wherein the locking lever has an abutment surface for the end portion of the guide, which is so arranged that the end portion of the guide upon being introduced into the receiving apparatus bears against the abutment surface with a tilting movement of the locking lever against the spring bias. The locking apparatus further include a locking opening or locking bore arranged on the outer rail or another stationary part. The locking lever has a free end which to prevent displacement of the slide along the outer rail can be brought into engagement with the locking opening or locking bore. When the free end of the locking lever is disposed over the locking opening or locking bore then, if no force is exerted on the locking lever by the free end of the guide, the locking lever is tilted by the spring force in such a way that the free end of the locking lever moves into the locking opening or locking bore. That causes the slide to be locked to prevent displacement along the outer rail.

Desirably, for bringing the guide of the slide-out member into engagement with the slide, provided on the slide or the receiving apparatus is a tilting lever carrier and a tilting lever which is mounted rotatably thereto, wherein at a free end the tilting lever has a latching tongue which is so designed that it can be brought into engagement with a latching opening on the guide by tilting movement of the tilting lever.

Furthermore, there is desirably provided on the stationary outer rail or a part which is fixedly connected thereto, an inclined unlocking portion which is so designed and arranged that the free end of the tilting lever which is in opposite relationship to the latching tongue moves onto the inclined unlocking portion when the slide is moved into the forward displacement position, and the tilting lever is tilted in a direction in which the latching tongue on the tilting lever is out of engagement with the latching opening on the guide. By virtue of the free end of the tilting lever moving onto the inclined unlocking portion, and the resulting tilting movement of the tilting lever, the guide of the slide-out member is released and the slide-out member can be removed from the slide or the receiving apparatus and can be taken out of the carcass or oven.

When the slide-out member is fitted into the carcass or oven the guide is introduced into the receiving apparatus on the slide until it comes to bear against the abutment surface of the locking lever and in so doing tilts it against a spring bias. With that tilting movement the free end of the locking lever is moved out of the locking opening or locking bore and the slide released for displacement with respect to the outer rail in the insertion direction. During the initial short displacement travel of the slide in the insertion direction the one free end of the tilting lever which is provided for engagement of the guide with the slide is guided downwardly by the inclined unlocking portion and is tilted by a spring bias in such a way that the latching tongue is pressed at the opposite free end of the tilting lever in the direction of the guide. On the side which is towards the latching tongue the free end of the guide has a corresponding latching opening into which the latching tongue then moves and brings the guide of the slide-out member into engagement with the slide to prevent it from being unintentionally pulled out. The slide-out member is now secured to the slide and the slide is freely displaceable with respect to the outer rail so that the slide-out member can be moved into the carcass or oven.

Removal of the slide-out member is effected with the reverse sequence of movements, in which respect there is desirably provided on the inclined introduction portion a contact step which the free end of the tilting lever can overcome only when the tilting lever is already slightly initially tilted by lifting movement of the slide-out member and the exertion of a downwardly directed force on the latching tongue arranged at the opposite end. Otherwise the free end of the tilting lever would already pass onto the inclined unlocking portion with completely horizontal displacement of the slide-out member, and release the guide of the slide-out member from the slide. The result of that would be that the slide-out member would already be released from the slide in normal horizontal operation in the extended position, and could drop out. That is prevented by virtue of the fact that, in the horizontal displacement of the slide-out member, the free end of the tilting lever bears against the step on the inclined unlocking portion and cannot move up onto same. It is only by virtue of the slight lifting movement of the slide-out member at the front end thereof that the free end of the tilting lever is lifted and passed over the step so that complete release of the guide is effected by moving the latching tongue out of the latching opening on the guide.

Variant 4

In a further variant of the linear guide system according to the invention the locking apparatus for locking the slide to prevent displacement along the outer rail and the engagement apparatus for engaging the guide of the slide-out member with the slide have on the slide or in the receiving apparatus respectively a spring holder with a first leaf spring which is fixed to the spring holder and which at its free end has an inclined unlocking portion and a locking pin which extends from the leaf spring, and with a second leaf spring which is fixed to the spring holder and which has an intermediate locking pin extending from the leaf spring and a latching tongue extending in the opposite direction for engagement with the latching opening at the end portion of the guide of the slide-out member.

Upon insertion of the guide of the slide-out member into the receiving apparatus on the slide, the free end of the guide is guided under and against the inclined unlocking portion on the first leaf spring. In that situation the first leaf spring is lifted and the locking pin which projects downwardly in a vertical direction from the leaf spring is moved out of the corresponding locking opening or locking bore. That causes the slide to be unlocked with respect to the outer rail.

The second leaf spring which is arranged beneath the first leaf spring in a vertical direction has an upwardly projecting latching tongue which is provided for engagement with a corresponding latching opening at the underside of the free end of the guide. The free end of the guide is desirably bevelled for passing over and depressing the latching tongue against the spring bias of the second leaf spring. When the guide of the slide-out member is inserted into the receiving apparatus, the free end of the guide passes over the latching tongue and urges it downwardly. Provided at the free end of the second leaf spring is an intermediate locking pin which projects downwardly in a vertical direction and which, when the latching tongue is passed over and the second leaf spring is depressed, engages into a corresponding intermediate locking opening or intermediate locking bore. As soon as the latching opening on the guide is arranged over the latching tongue and the latching tongue engages into the latching opening, the intermediate locking pin is lifted again out of the intermediate locking opening or intermediate locking bore. That intermediate locking arrangement serves to provide that the slide is not already released for displacement with respect to the outer rail before the latching tongue is in engagement with the latching opening on the guide for securing the slide-out member to the slide.

The invention will now be further described by means of the description hereinafter of preferred variants (variants 1 to 4) and the accompanying Figures.

Figure 1B:
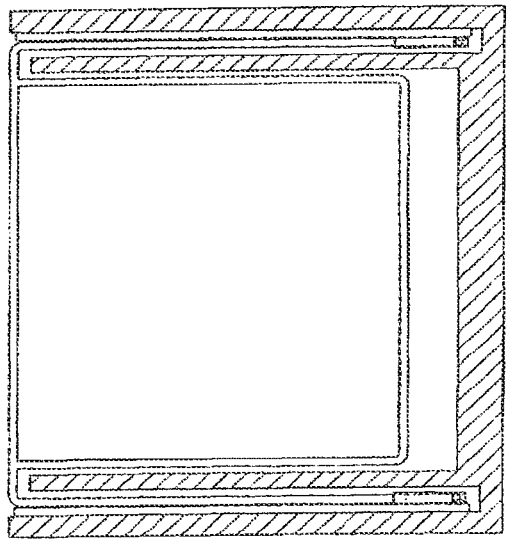

FIG. 1 is a diagrammatic view in cross-section from above of a baking oven 4 having a muffle side wall 5, a muffle rear wall 6 and an outside wall 7, wherein the muffle side wall and the outside wall 7 define between them an intermediate space 8 which is also referred to as the cold region. The linear guide system according to the invention is arranged in the cold region 8, which has the advantage that it is not in contact with the cooking space and therefore on the one hand is not contaminated by splashes or vapours from the material being cooked and on the other hand it is not exposed to the high temperatures which prevail in the cooking space of the oven. By virtue of that arrangement in the cold region 8, it is possible to use for the linear guide system materials which would not withstand the high temperatures in the cooking space. By way of example, for the ball bearing arrangements between the outer rail and the slide it is possible to use lubricating greases which would break down or at least lose their good lubricating properties at excessively high temperatures. The linear guide system according to the invention is only diagrammatically illustrated in FIG. 1, wherein the outer rail 9 which is mounted to the outside wall 7 and the slide 10 fixed displaceably therein can be seen therefrom.

In addition FIG. 1 shows a slide-out member 1 comprising a support element or inner frame 2 which is suitable for example for the placement of a support for items to be cooked, and guides 3 which extend from the front side of the support element 2 to beyond the rear side thereof in parallel relationship with the support element 2. The guides 3 are connected to the support element in the front region by way of a U-shaped connecting portion. The upper view in FIG. 1 shows the slide-out member and the baking oven separated from each other while the lower view in FIG. 1 shows the slide-out member fitted into and introduced into the baking oven and the linear guide system according to the invention.

Figure 2:
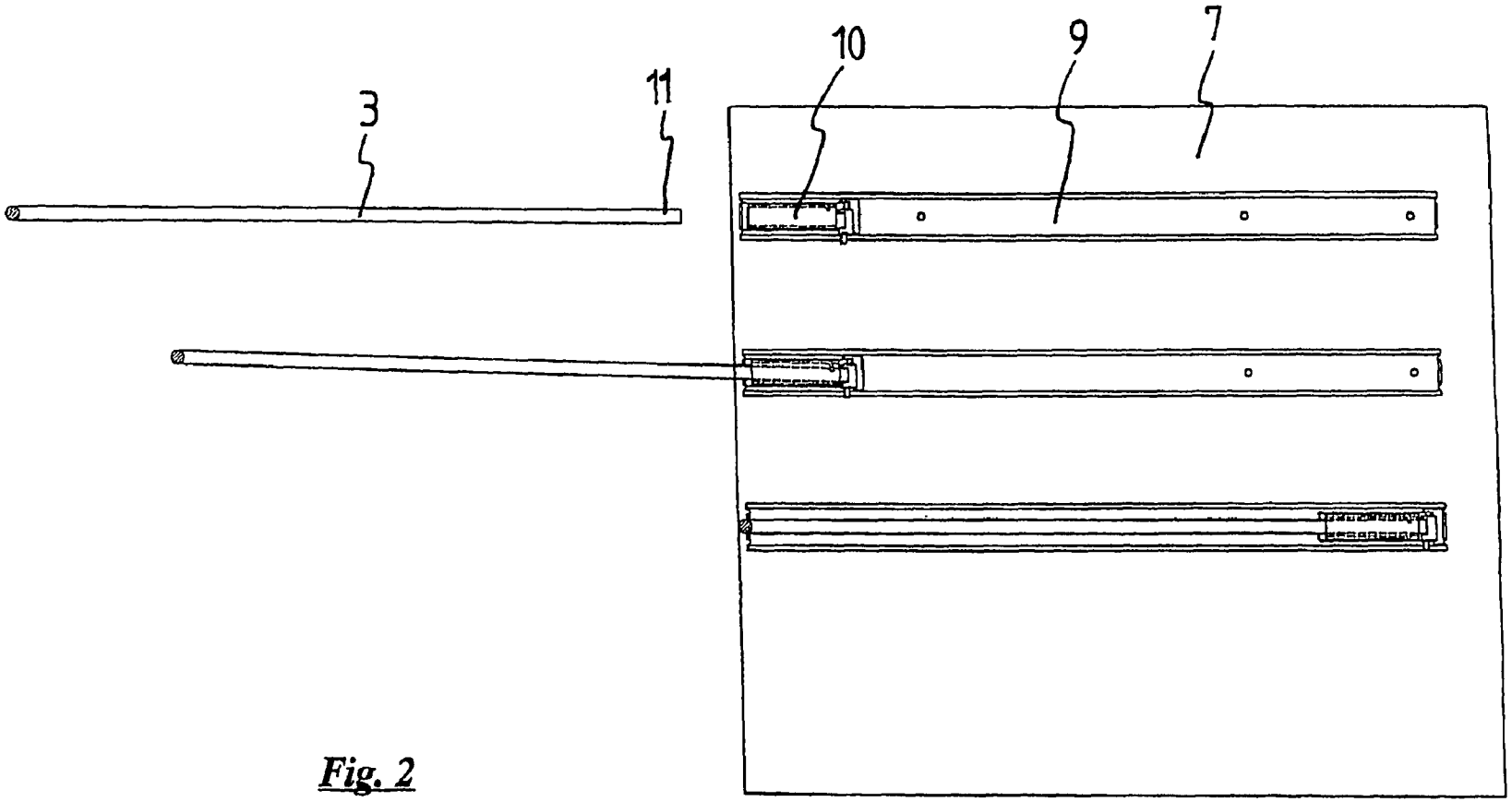
FIG. 2 shows the outside wall of the oven of FIG. 1 with a plurality of linear guide systems arranged thereon in accordance with a first variant (variant 1) of the present invention from the side.
Figure 3A:
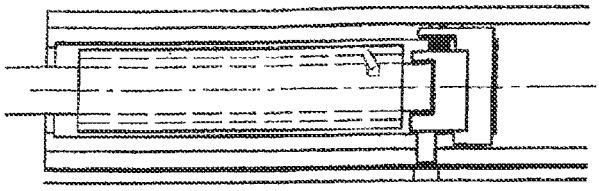
FIG. 3 shows detail views of the first variant (variant 1) of the linear guide system according to the invention as shown in FIG. 2 in various stages in insertion of a slide-out member.
Figure 3B:
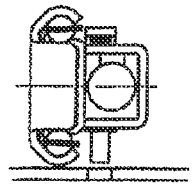
Figure 3C:
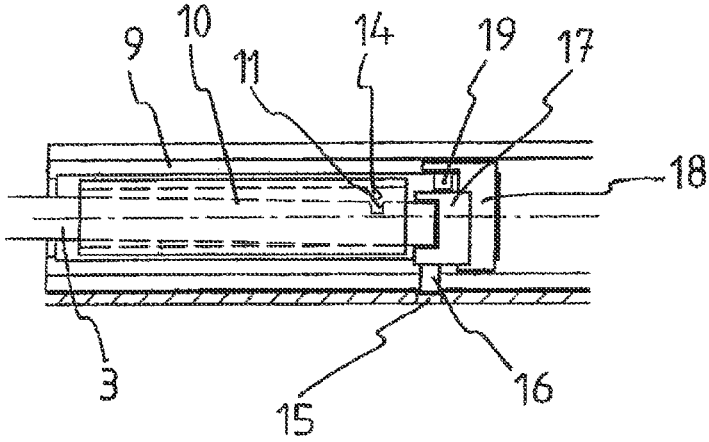
Figure 3D:
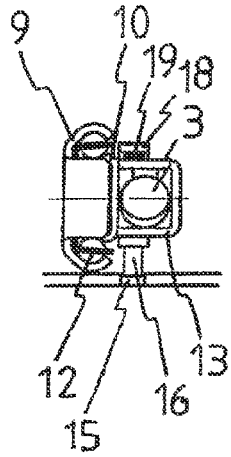
Figure 3E:
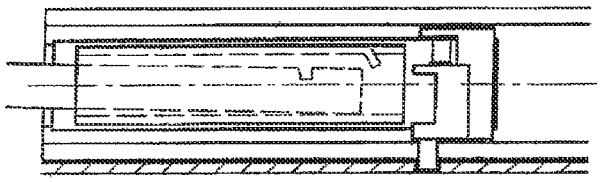
Figure 3F:
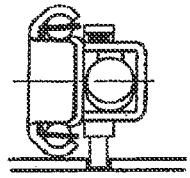
Figure 4A:
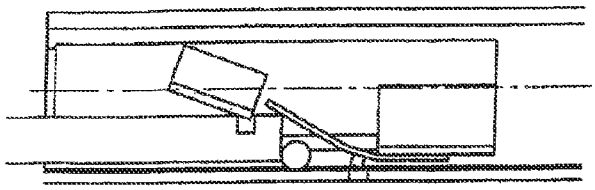
FIG. 4 shows detail views of a second variant (variant 2) of the linear guide system in various stages in insertion of a slide-out member.
Figure 4B:
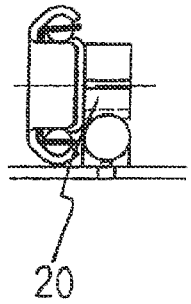
Figure 4C:
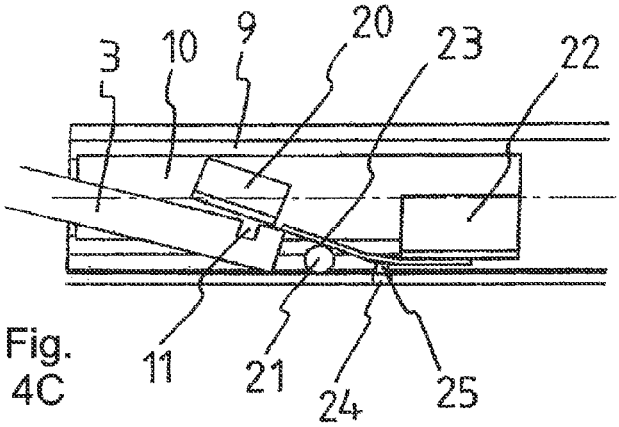
Figure 4D:
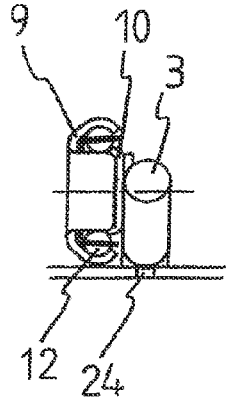
Figure 4E:
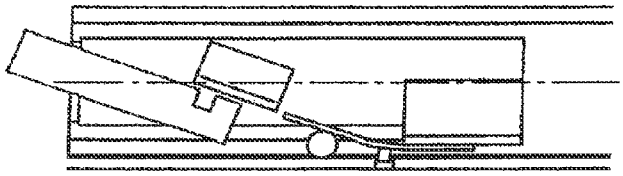
Figure 4F:
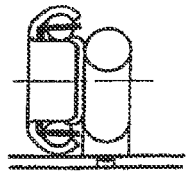
Figure 6A:
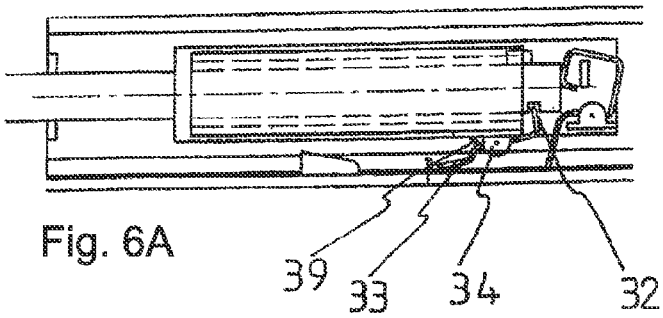
FIG. 6 shows detail views of a fourth variant (variant 4) of the linear guide system in various stages in insertion of a slide-out member.
Figure 6B:
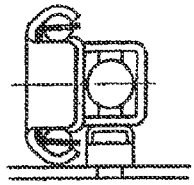
Figure 6C:
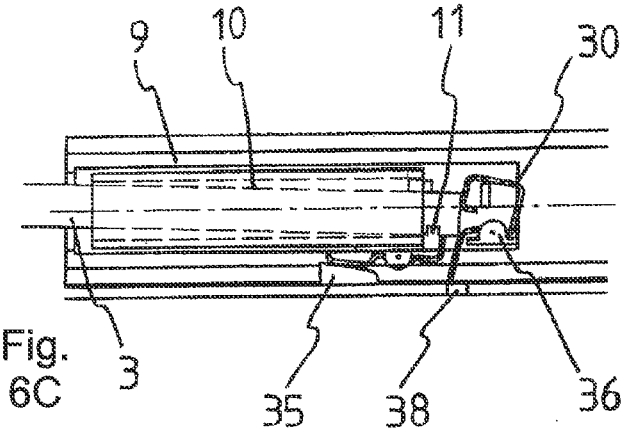
Figure 6D:
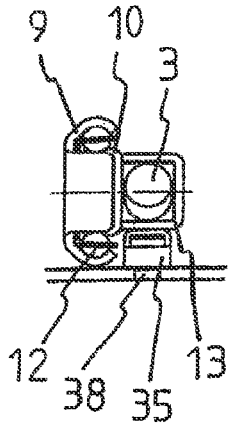
Figure 6E:
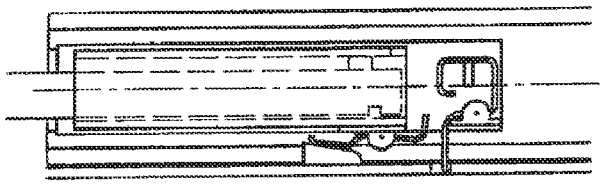
Figure 6F:
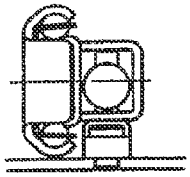

FIGS. 2 and 3 show a first variant in accordance with above-described variant 1 of the linear guide system according to the invention, which is particularly preferred. FIG. 2 shows the outside wall 7 of a carcass or baking oven, as is shown in FIG. 1. Three linear guide systems according to the invention are shown one above the other on the outside wall 7 in various displacement and locking states. FIG. 2 shows only the guide 3 of the slide-out member as is shown in FIG. 1. At its free end the guide 3 has on the top side thereof a latching opening 11 for coming into engagement with the slide 10 of the linear guide system. The slide 10 is connected to the outer rail 9 displaceably by way of a ball bearing arrangement. The central view in FIG. 2 shows the state upon insertion of the guide into the linear guide system while the lower view in FIG. 2 shows the guide 3 and the linear guide system with the slide-out member in the introduced position.

FIG. 3 shows one above the other three different states of the linear guide system according to the invention of the first variant in the insertion of the guide 3 of a slide-out member, wherein in each case a diagrammatic side view of the slide 10 and the outer rail 9 is shown at the left and a corresponding view from the front is shown at the right.

The linear guide system of the first variant includes an outer rail 9, a slide 10 and a receiving apparatus 13 which is fitted onto the slide 10 and which in this variant is in the form of a U-shaped profile member in which the respective free ends of the limbs of the U-shape are fixed to the rear side of the slide and thus constitute a tube for introduction of the guide 3. On its top side in the proximity of the free end the guide 3 has a latching opening 11. The receiving apparatus 13 has a suitably inwardly bent latching tongue 14 for engagement of the guide 3 of the slide-out member with the slide 10. In the upper view in FIG. 3 the latching tongue 14 is engaged into the latching opening 11 so that the guide 3 is secured to prevent it from being pulled out of the receiving apparatus 13. The linear guide system of this first variant has locking apparatus for locking the slide 10 to prevent displacement along the outer rail 9. Those locking apparatus include a locking member 17 which is mounted slidably in the vertical direction on a locking guide 18 fixed to the slide 10. The locking member 17 is biased downwardly in a vertical direction by a spring 19. At the underside the locking member 17 has a locking pin 16. Provided for the latching action on a stationary plate portion is a suitable locking opening or locking bore 15 into which the locking pin can move for locking the slide 10 with respect to the outer rail 9, as is shown in the central and lower views in FIG. 3. The locking member 17 is provided on the side at the left in FIG. 3 with an opening into which the free end of the guide 3 can pass and come into engagement with the locking member 17.

The upper view in FIG. 3 shows the state of the linear guide system in which the guide 3 is in engagement with the slide 10 and the locking pin 16 has been lifted out of the locking opening or locking bore 15 so that the slide together with the slide-out member can be displaced along the outer rail 9 and the guide 3 is at the same time secured to the slide 10 to prevent it from being pulled out of the receiving apparatus 13. The engagement of the free end of the guide 3 with the locking member 17 means that the locking member 17 is held up against the biasing force of the spring 19 so that the locking pin 16 cannot pass into the locking bore 15 or upon displacement of the slide 10 along the outer rail 9 cannot rub on the stationary plate portion in which the locking bore 15 is provided.

The central view in FIG. 3 shows the process involved when locking the slide 10 with respect to the outer rail 9 and when the guide 3 is brought out of engagement with the slide 10. For that purpose the guide 3 is slightly tilted by lifting the slide-out member at the front end, in which case the locking member 17 is moved vertically downwardly and the locking pin 16 moves into the locking opening or locking bore 15 provided for it. At the same time the latching tongue 14 is brought out of engagement with the latching opening 11 at the free end of the guide 3. As is shown in the lower view in FIG. 3 the guide can now be pulled out of the receiving apparatus 13 and the slide 10 is locked to prevent displacement along the outer rail 9, by engagement of the locking pin 16 into the locking opening or locking bore 15. That prevents the slide from being unintentionally displaced rearwardly, such as for example when the slide-out member is freshly inserted, and prevents insertion of the slide-out member being made more difficult as a result.

FIG. 4 shows various stages as are also shown in FIG. 3 in respect of a second variant in accordance with above-described variant 2 of the linear guide system according to the invention, in which the locking apparatus for locking the slide 10 to prevent displacement along the outer rail 9 include a spring support 22 with a leaf spring 23 fixed thereto. Provided on the leaf spring 23 is a downwardly extending locking pin 25 which locks the slide to prevent displacement when it engages into the corresponding locking opening or locking bore 24 in a stationary plate portion. The view at the top in FIG. 4 shows the state in which the guide 3 is in engagement with the slide 10 to prevent inadvertent removal and the slide 10 is unlocked with respect to the outer rail 9 in regard to displacement thereof. The free end of the guide 3 has a latching opening 11 on the top side thereof. Provided on the slide 10 is an inclined introduction portion 20 for introduction of the guide 3. An edge of the inclined introduction portion 20 is of such a configuration and arrangement that it comes into engagement with the latching opening 11 at the free end of the guide 3 for securing the guide 3 to the slide 10, as shown in the top view in FIG. 4. When the guide 3 is not introduced, the free end of the leaf spring 23 bears against an abutment 21. When the guide 3 is introduced, it is guided along the inclined introduction portion 20 under the free end of the leaf spring 23 and urges the free end of the leaf spring 23 upwardly against the spring bias. In that situation the locking pin 25 is lifted out of the locking opening or locking bore 24 and the slide 10 is released for displacement with respect to the outer rail 9.

To remove the slide-out member out of the carcass or baking oven, the guide 3 is slightly tilted by lifting the slide-out member at the front side thereof, and pulled back, as shown in the central view in FIG. 4. The leaf spring 23 follows its spring bias and moves downwardly onto the abutment 21, in which case the locking pin 25 moves into the locking opening or locking bore 24 and locks the slide 10 to prevent displacement along the outer rail 9. Insertion of the slide-out member is effected in the reverse sequence, that is to say from bottom to top in the views in FIG. 4.

FIG. 5 shows a third variant in accordance with the above-described variant 3 of the linear guide system according to the invention, wherein the locking apparatus for locking the slide 10 to prevent displacement along the outer rail 9 include a locking lever 30 which is mounted rotatably to a lever carrier 36 and which is biased by a spring (not shown). In the pull-out withdrawal direction the locking lever 30 has an abutment, against which the guide 3 presses upon insertion of the slide-out member and tilts the locking lever 30 in opposite relationship to its spring bias. The opposite free end of the locking lever 30 is so designed that it can move into a corresponding locking opening or locking bore 38 on a stationary plate portion, for locking the slide 10 to prevent displacement along the outer rail 9.

As in the first variant shown in FIGS. 2 and 3, this variant also has a U-shaped profile member which, together with the rear side of the slide 10, forms the receiving apparatus 13. A tilting lever 33 is held rotatably to a tilting lever carrier 34 at the underside of the receiving apparatus 13. The one free end of the tilting lever forms a latching tongue 32 which can be brought into engagement with a corresponding latching opening 11 at the free end of the guide 3. The tilting lever 33 is biased by a spring 39 in such a way that the latching tongue 32 is urged upwardly into the latching opening 11 on the guide 3. Also provided on the stationary plate portion is an inclined unlocking portion 35 onto which the free end of the tilting lever 33, which in opposite relationship to the latching tongue 32, passes when the slide is moved in the pull-out direction to the end of the outer rail. When the free end of the tilting lever 33 runs up onto the inclined unlocking portion 35 the tilting lever 33 is tilted and the latching tongue 32 is moved out of the latching opening 11 on the guide 3. In that situation the guide 3 is moved out of engagement with the slide 10 and can be pulled out of the receiving apparatus 13. The inclined unlocking portion 35 is provided with a step over which the free end of the tilting lever 33 must be lifted before it can be moved further over the inclined unlocking portion 35. The lifting movement of the free end of the tilting lever 33 is produced by tilting motion of the guide 3, by the slide-out member being lifted in the front region, in which case the free end of the guide 3 presses onto the latching tongue 32, tilts the tilting lever 33 in opposite relationship to the spring bias by the spring 39 and lifts the opposite free end for passing over the step on the inclined unlocking portion 35.

When the guide 3 is pulled out of the receiving apparatus 13, as shown in the central and lower views in FIG. 5, the locking lever 30 is tilted in the direction of its spring bias, it moves with its free end into the locking opening or locking bore 38, and it secures the slide 10 to prevent displacement along the outer rail 9.

FIG. 6 shows a fourth variant in accordance with the above-described variant 4 of the linear guide system according to the invention, in which the locking apparatus include first and second leaf springs 40 and 48 fixed to a spring holder 47. The first leaf spring 40 has a locking pin 41 which projects downwardly in a vertical direction and which can be introduced into a corresponding locking opening or locking bore 42 for locking the slide to prevent displacement along the outer rail 9. In addition at its free end the first leaf spring 40 has an inclined unlocking portion 46 against which the free end of the guide 3 abuts upon the introduction thereof, lifts the first leaf spring 40 against its spring bias and in so doing moves the locking pin 41 out of the locking opening or locking bore 42. The second leaf spring 48 is arranged beneath the first leaf spring 40 in a vertical direction and has an upwardly projecting latching tongue 45 which can be brought into engagement with a corresponding latching opening 11 at the underside of the guide 3 for securing the guide to the slide.

At its free end the second leaf spring 48 also has an intermediate locking pin 43 which, when the second leaf spring 48 is depressed, moves into a corresponding intermediate locking bore 44, as is shown in the central view in FIG. 6. The free end of the guide 3 has an inclined portion which upon insertion of the guide 3 is guided over the locking pin 41 of the second leaf spring 48 and in that situation depresses it. In that case intermediate locking is effected by the intermediate locking pin 43 engaging into the intermediate locking bore 44 in order to prevent the slide 10 from being able to already move out of its position in that insertion operation. As soon as the latching tongue 45 on the second leaf spring 48 engages into the latching opening 11 on the guide 3 the intermediate locking pin 43 is lifted out of the intermediate locking bore 44 again. The guide 3 is then in engagement with the slide 10 by way of the latching tongue 45 and the latching opening 11 and is secured and the slide can be displaced together with the slide-out member along the outer rail 9.

When the guide 3 is moved out of the receiving apparatus 13, the free end of the guide 3 is guided away from the inclined unlocking portion 46 of the first leaf spring 40 so that the leaf spring 40 can yield to its spring bias and can urge the locking pin 41 downwardly into the locking opening or locking bore 42 as is shown in the lower view in FIG. 6. The slide 10 is locked in that position to prevent displacement thereof along the outer rail 9.

LIST OF REFERENCES

1 slide-out member
2 support element or inner frame
3 guide
4 carcass or baking oven
5 carcass side wall or muffle side wall
6 carcass rear wall or muffle rear wall
7 outside wall
8 intermediate space or cold region
9 outer rail (stationary)
10 slide (movable)
11 latching opening
12 ball bearing arrangement
13 receiving apparatus
14 latching tongue
15 locking opening or locking bore
16 locking pin
17 locking member
18 locking guide
19 spring
20 inclined introduction portion
21 abutment
22 spring support
23 leaf spring
24 locking opening or locking bore
25 locking pin
30 locking lever
32 latching tongue
33 tilting lever
34 tilting lever carrier
35 inclined unlocking portion
36 lever carrier
38 locking opening or locking bore
39 spring
40 first leaf spring
41 locking pin
42 locking opening or locking bore
43 intermediate locking pin
44 intermediate locking bore
45 latching tongue
46 inclined unlocking portion
47 spring holder
48 second leaf spring

What is claimed is:

1. A linear guide system in a drawer system comprising:

a slide-out member (1) which includes a support element (2) and two elongate guides (3) extending rearwardly laterally of the support element (2), at least one pair of stationary outer rails (9) which are mounted in a horizontally extending position on the inside of a carcass wall (7) and slides (10) each of which is supported on a respective outer rail (9) slidably along the length thereof, engagement apparatus (11, 14, 20, 32, 45) for bringing the guides (3) of the slide-out member (1) into engagement with the slides (10), and locking apparatus (15, 16, 24, 25, 30, 38, 41, 42) for locking at least one of the slides (10) to prevent displacement along at least one of the outer rails (9), said locking apparatus being adapted for locking the at least one slide (10) in an extended position with respect to displacement travel of the slide-out member (1), wherein the locking apparatus (15, 16, 24, 25, 30, 38, 41, 42) for locking the at least one slide (10) to prevent displacement along the at least one outer rail (9) locks the at least one slide (10) against displacement when the guide (3) of the slide-out member (1) engaged with the at least one slide (10) is brought out of engagement with the at least one slide (10) in order to enable the removal of the slide-out member (1) from the carcass wall (7), and unlocks the at least one slide (10) for displacement along the at least one outer rail (9) when the guides (3) of the slide-out member (1) are brought into engagement with the at least one slide (10).

2. The linear guide system according to claim 1 wherein locking apparatus (15, 16, 24, 25, 30, 38, 41, 42) is provided for locking both slides (10) to prevent displacement along respective outer rails (9), said locking apparatus being adapted for locking the slides (10) in an extended position with respect to displacement travel of the slide-out member (1), wherein the locking apparatus (15, 16, 24, 25, 30, 38, 41, 42) for locking both slides (10) to prevent displacement along the respective outer rails (9) locks the slides (10) against displacement when the guides (3) of the slide-out member (1) engaged with the slides (10) is brought out of engagement with the slides (10) and unlocks the slides (10) for displacement along the outer rails (9) when the guides (3) of the slide-out member (1) are brought into engagement with the at least one slide (10).

3. The linear guide system according to claim 1 wherein the slides (10) are mounted slidably along the outer rail (9) by a sliding guide, a rolling or roller bearing or a ball bearing (12).

4. The linear guide system according to claim 1 wherein the elongate guides (3) are in the form of rods or tube profile members of circular or polygonal cross-section, which extend rearwardly in parallel relationship with the side edges of the support element (2).

5. The linear guide system according to claim 1 wherein the elongate guides (3) extend rearwardly beyond a rear end of the support element (2).

6. The linear guide system according to claim 1 wherein the length of the slides (10) is at most ⅓ of the length of its respective outer rail (9).

7. The linear guide system according to claim 1 wherein the length of the slides (10) is at most ¼ of the length of its respective outer rail (9).

8. The linear guide system according to claim 1 wherein the length of the slides (10) is at most ⅕ of the length of its respective outer rail (9).

9. The linear guide system according to claim 1 wherein a receiving apparatus (13) provided on the slide (10) is preferably in the form of a tube profile member or U-shaped profile member which extends in the longitudinal direction of its slide (10) said receiving apparatus being fixed to its slide (10), for introduction of one of the guides (3) and engagement thereof with the slide (10).

10. The linear guide system according to claim 1 wherein the engagement apparatus (11, 14, 20, 32, 45) for bringing the guides (3) of the slide-out member (1) into engagement with the slides (10) include latching openings (11) on the guides (3) and a latching nose or latching tongue (14, 20, 32, 45) which is fixedly connected to the slides (10) and which can be brought into engagement with the latching opening (11).

11. The linear guide system according to claim 1 wherein the locking apparatus (15, 16, 24, 25, 30, 38, 41, 42) for locking the at least one slide (10) to prevent displacement along the outer rail (9) include on the at least one slide (10) a locking pin (16, 25, 41) and on the stationary outer rail (9), or a part fixedly connected thereto, a locking opening or locking bore (15, 24, 38, 42) into which the locking pin (16, 25, 41) engages for locking the at least one slide (10) to prevent displacement along the outer rail (9).

12. The linear guide system according to claim 11 wherein the locking pin (16, 25, 41) is spring-biased by means of a spring (19, 23, 37, 40) in the direction of the locking opening or locking bore (15, 24, 38, 42) or under the force of gravity is subjected to a force in the direction of the locking opening or locking bore (15, 24, 38, 42).

13. The linear guide system according to claim 1 wherein the locking apparatus for locking the at least one slide (10) to prevent displacement along the at least one outer rail (9) includes a locking guide (18) mounted to the at least one slide (10) and a locking member (17) which is guided slidably on the locking guide (18) and from which a locking pin (16) projects, wherein the locking guide (18), the locking member (17) and the locking pin (16) are so arranged and designed that the locking member (17) is displaceable slidably against the locking guide (18) between positions in which the locking pin (16) engages into a locking opening or locking bore (15) for locking the at least one slide (10) to prevent displacement along the at least one outer rail (9) and the locking pin (16) is lifted out of the locking opening or locking bore (15) to permit movement of the at least one slide (10).

14. The linear guide system according to claim 13 wherein the locking member (17) has an opening which is designed for engagement with an end portion of one of the guides (3).

15. The linear guide system according to claim 1 wherein the locking apparatus for locking the at least one slide (10) to prevent displacement along the at least one outer rail (9) have on the slide (10), or in the receiving apparatus (13), a spring support (22) mounted to the at least one slide (10) and a leaf spring (23) which is fixed to the spring support (22) and from which a locking pin (25) extends, wherein the free end of the leaf spring (23), which in opposite relationship to the end of the leaf spring (23) that is fixed to the spring support, (22) faces in the pull-out direction of the at least one slide (10).

16. The linear guide system according to claim 15 wherein provided on the at least one slide (10), or in the receiving apparatus 13, there is further an inclined introduction portion (20) for introduction of the guide (3), wherein the inclined introduction portion is so arranged that upon introduction of the guide (3) into the receiving apparatus (13) it moves the end portion of the guide (3) to the free end of the leaf spring (23) in such a way that the leaf spring (23) is deformed in opposite relationship to its bias and in so doing lifts the locking pin (25) out of a locking opening or locking bore (24).

17. The linear guide system according to claim 16 wherein a part of the inclined introduction portion (20) is so designed and arranged that upon introduction of the guide (3) into the receiving apparatus (13) said part engages into a latching opening (11) at the end portion of the guide (3) for bringing the guide (3) of the slide-out member (1) into engagement with the slide (10).

18. The linear guide system according to claim 1 wherein the locking apparatus for locking the at least one slide (10) to prevent displacement along the at least one outer rail (9) have on the slide (10) or in the receiving apparatus (13) a locking lever (30) which is mounted rotatably on a lever carrier (36) and is resiliently biased in the locking direction by a spring (37), wherein the locking lever (30) has an abutment surface for the end portion of the guide (3), which is so arranged that the end portion of the guide (3) upon introduction into a receiving apparatus (13) bears against the abutment surface with tilting of the locking lever (30) in opposite relationship to the spring bias.

19. The linear guide system according to claim 18 wherein the locking apparatus further includes a locking opening or locking bore (38) and the locking lever has a free end which to prevent displacement of the at least one slide (10) along the at least one outer rail (9) can be brought into engagement with the locking opening or locking bore (38).

20. The linear guide system according to claim 18 wherein further including, on the at least one slide (10) or the receiving apparatus (13), a tilting lever carrier (34) and a tilting lever (33) mounted rotatably thereto, wherein at a free end, the tilting lever has a latching tongue (32) which is so designed that by tilting movement of the tilting lever (33) it can be brought into engagement with a latching opening (11) on the guide (3) for bringing the guide (3) of the slide-out member (1) into engagement with the at least one slide (10).

21. The linear guide system according to claim 20 wherein an inclined unlocking portion (35) is further provided on the stationary outer rail (9) or a part fixedly connected thereto, said inclined unlocking portion is so designed and arranged that the free end of the tilting lever (33), that is opposite to the latching tongue (32), passes onto the inclined unlocking portion (35) when the at least one slide (10) is moved into the front displacement position and the tilting lever (33) is tilted in a direction in which the latching tongue (32) on the tilting lever (33) is out of engagement with the latching opening (11) on the guide (3).

22. The linear guide system according to claim 1 wherein the locking apparatus for the at least one locking the slide (10) to prevent displacement along the outer rail (9) and the engagement apparatus for bringing the guide (3) of the slide-out member (1) into engagement with the slide (10) include on the slide (10), or in the receiving apparatus, (13) a spring holder (47) with a first leaf spring (40) which is fixed to the spring holder (47) and which at its free end has an inclined unlocking portion (46) and a locking pin (41) extending from the leaf spring, and with a second leaf spring (48) which is fixed to the spring holder (47) and which has an intermediate locking pin (43) extending from the leaf spring and a latching tongue (45) extending in the opposite direction for engagement with the latching opening (11) at the end portion of the guide (3) of the slide-out member (1).

23. A linear guide system in a drawer system comprising:

a slide-out member (1) including a support element (2) and two elongate guides (3) extending rearwardly laterally of the support element (2), at least one pair of stationary outer rails (9) which are mounted in a horizontally extending position on the inside of a carcass wall (7) and slides (10) each of which is supported on a respective outer rail (9) slidably along the length thereof, engagement apparatus (11, 14, 20, 32, 45) for bringing the guides (3) of the slide-out member (1) into engagement with the slides (10), and locking apparatus (15, 16, 24, 25, 30, 38, 41, 42) for locking at least one of the slides (10) to prevent displacement along at least one of the outer rails (9), said locking apparatus being adapted for locking the at least one slide (10) in an extended position with respect to displacement travel of the slide-out member (1), wherein the locking apparatus (15, 16, 24, 25, 30, 38, 41, 42) for locking the at least one slide (10) to prevent displacement along the at least one outer rail (9) locks the at least one slide (10) against displacement when the guide (3) of the slide-out member (1) engaged with the at least one slide (10) is brought out of engagement with the at least one slide (10) in order to enable the removal of the slide-out member (1) from the carcass wall (7), and unlocks the at least one slide (10) for displacement along the at least one outer rail (9) when the guides (3) of the slide-out member (1) are brought into engagement with the at least one slide (10), wherein the engagement apparatus (11, 14, 20, 32, 45) for bringing the guides (3) of the slide-out member (1) into engagement with the slides (10) include latching openings (11) on the guides (3) and a latching nose or latching tongue (14, 20, 32, 45) which is fixedly connected to the slides (10) and that can be brought into engagement with the latching opening (11).

* * * * *